United States Patent [19]

Guindin

[11] Patent Number: 4,766,650

[45] Date of Patent: Aug. 30, 1988

[54] TRAVELING FLAT MOUNTING MEANS

[76] Inventor: David Guindin, Pedernera 247, Villa Progreso Prov. Buenos Aires, Argentina, 1650

[21] Appl. No.: 45,068

[22] Filed: May 1, 1987

[30] Foreign Application Priority Data

May 14, 1986 [AR] Argentina ..... 303.959

[51] Int. Cl.[4] ..... D01G 15/24

[52] U.S. Cl. ..... 19/103; 19/111

[58] Field of Search ..... 19/103, 111

[56] References Cited

U.S. PATENT DOCUMENTS

| | | | |
|---|---|---|---|
| 458,576 | 9/1891 | Hildreth | 19/103 |
| 468,855 | 2/1892 | Whitworth | 19/103 |
| 2,678,112 | 5/1954 | McDaniel . | |

FOREIGN PATENT DOCUMENTS

| | | | |
|---|---|---|---|
| 0144184 | 12/1985 | European Pat. Off. . | |
| 40500 | 9/1887 | Fed. Rep. of Germany . | |
| 0002366 | of 1886 | United Kingdom | 19/103 |
| 034780 | 11/1929 | United Kingdom . | |

*Primary Examiner*—Louis K. Rimrodt
*Attorney, Agent, or Firm*—Darby & Darby

[57] ABSTRACT

Improvements in textile raw material card machines of the type of a machine that comprises a structure whereupon a horizontal transversal carding cylinder is rotatively mounted, its revolution surface being provided with barbs and operatively related with an upper carding surface that comprises an endless conveyor formed by a plurality of carding "sheets" (i.e., traveling flats) transversally mounted in relation to the forward direction of said conveyor an articulated among each other, said endless conveyor is disposed in such a way that its lower portion copies correspondingly the curvature of an upper circunferential sector of the carding cylinder, the improvements being that in the endless conveyor section that copies the curvature of the circunferential sector of the carding cylinder, the "sheets" ends are mounted on the periphery of a pair of coaxial idler wheels having approximately the same diameter as that of the cylinder and being freely mounted relative to the cylinder shaft.

2 Claims, 1 Drawing Sheet

TRAVELING FLAT MOUNTING MEANS

The present invention relates to improvements in textile raw material card machines.

More precisely, it is an object of this invention to provide substantially advantageous and useful improvements in machines which, in the textile industry, are used to prepare unmanufactured textile raw material, in which fibers are compacted and entagled, thus proving insuitable for subsequent processing.

To such respect, in said machines, fleece and textile raw material in general are carried along cooperating surfaces provided with little barbs and/or teeth that separate the fibers, giving all of them the same direction, for the subsequent spinning process.

Prior art card machines present a compact structure, with a carding drum or cylinder of great diameter horizontally mounted on it; its revolution surface is provided with barbs and/or peripheral teeth. This carding surface operates, in an upper circunferential section, in connection with another carding surface which comprises an endless conveyor of continuous movement, also provided with barbs and/or teeth placed alternatively spaced with those of the cylinder.

There are card machines in which the upper carding surface (that operates in the upper circunferential section of the carding cylinder or drum) comprises a plurality of rotative carding rollers articulated operatively by means of transmissions formed by sprockets and chains.

The problem with this type of machines is that they require a considerable number of upper rollers in order to use as much operative surface of the upper circunferential section of the major carding cylinder or drum as possible, thus resulting in higher costs and greater size.

In other available card machines the upper carding surface comprises an endless conveyor of continuous movement; this conveyor is made up of a plurality of "sheets" with barbs and/or teeth.

These "sheets" are articulated to each other and transversally placed in relation to the forward direction of the endless conveyor, and parallel to the major carding drum or cylinder shaft.

Said endless conveyor is guididly mounted on a wheel system; some of the wheels are driving and have teeth that relatedly engage with other teeth formed at the end of the "sheets".

Said wheel system, is mounted on suitable supports tight-fittedly distributed in a fixed manner at the sides of the machine structure; the upper edges of these sides have the same curvature as that of the major carding drum or cylinder, thus forming a pair of coaxial semicircular strips whereupon the ends of the "sheets" slide successively.

Although larger carding surface and more compact structures can be obtained with this kind of machines, same have disadvantages that considerably increase maintenance costs.

To such respect, and as already mentioned, the set of "sheets", when entering the operative area, guididly slide on the edges of the structure walls that copy the major carding drum or cylinder curvature, and friction between both surfaces leads to constant rectification of same.

As for the above mentioned, it is important to note that the "sheets" usually consist of cast iron slats, so that wearing out occurs only in said slats and not on the guides of the machine sides on which they slide.

This causes a construction limitation in the "sheets" lenght, and the consequent limitation in obtaining a larger carding surface.

Considering state of prior art in this matter, important improvements have been conceived which provide a final solution to the above mentioned problems.

Based on said improvements, the ends of the guided "sheets" forming the endless conveyor are supported in the operative circunferential area in cooperation with the major carding drum or cylinder, by two dynamic bearings which prevent friction and the consequent wearing out of the contacting parts.

Strictly from the point of view of construction, the improvements in the present invention provide a pair of idler wheels coaxially disposed with the major carding cylinder or drum whereupon the ends of the "sheets" that together form the endless conveyor rest.

The diameter of these wheels is substantially similar to that of said major carding cylinder or drum, so that the ends of the "sheets" rest successively on said wheels, which rotate rhythmically on their shafts, with no sliding either between the end surfaces of the "sheets" or of the wheels.

This construction solution also allows the construction of "sheets" from materials more resistant to bending, and consequently longer, by means of which it is possible to conceive comparatively wider card machines, thus increasing the carding surface of same.

The invention of the foregoing paragraphs has been analyzed in a general way, and gives and idea about his outstanding advantages, but a full description based on one of the preferred embodiments will stress its novelty concerning construction details.

Said description is referred to the drawings herewith enclosed and in which an advantageous form of putting the invention into practice has been represented schematically.

The drawings must be interpreted as a simple way of explanation, and not as a limitation to what will be further ahead claimed. In the drawings:

In said Figures, same referential signs stand for equal or corresponding parts.

Figure 1:
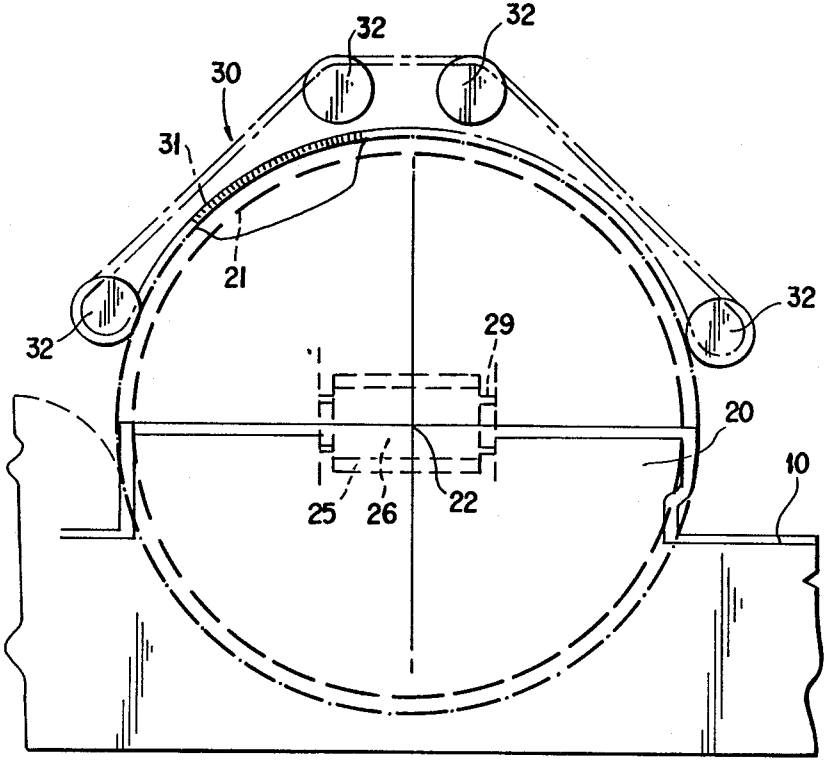

FIG. 1 is a schematic illustration of the profile of textile raw material processing machines, such as a card machine, of the type formed by a compact structure or chassis 10, whereupon a horizontal transversal carding cylinder 20 is rotatively mounted, its revolution surface being supplied with barbs and/or teeth 21.

Said cylinder 20 is axially mounted on a shaft 22 which, in turn, is mounted on bearings 23 located at the structure sidewalls 10; one of the ends of said shaft 22 is connected to suitable drive means (not shown), such as driving pulleys and belts, operated by an electric motor.

The carding surface formed by barbs and/or teeth 21 of the cylinder 20 is operatively related to an upper carding surface comprising an endless conveyor 30 formed by a plurality of "carding sheets" (i.e., flats) 31, transversally mounted in relation to the forward direction of the conveyor 30 and in an articulated relationship among each other.

Said endless conveyor formed by "sheets" (i.e., traveling flats) 31 is located so that its lower portion copies correspondingly the curve of an upper circunferential portion of the mentioned major carding cylinder 20.

The endless conveyor formed by the set of "sheets" 31 is mounted on a wheel system 31; some of these wheels are inertial and support the upper portion of the endless conveyor, and some others are driving and have teeth that engage projections 31' formed at the ends of the "sheets".

Said wheel system is mounted on respective supports 33 and are tight-fitted to the upper margins of the structure sidewalls or chassis 10; for this purpose, said sidewalls are preferably semicircular or sickle-like shaped.

Then, the corresponding faces of the "sheets" 31 are provided with barbs and/or teeth 34 that operate in cooperation with the barbs and/or teeth 21 of the major cylinder 20, shreding and orienting the textile raw material fibers.

It has to be noted that the end portions of the sheets, opposite to the projections 31', operate cooperatively in the lower portion of the endless conveyor, with dynamic support means.

According to the present invention, such end portions of the "sheets" 31 are mounted on the periphery of a pair of coaxially disposed idler wheels 40, adjacent to the ends of the cylinder 20.

Thus, the "sheets" 31 that successively form the lower portion of the endless conveyor 30 rest on said wheels that follow the rotational movement of said conveyor 30 and cylinder 20, without friction between contacting parts.

Wheels 40 are tight-fittidly provided in order to regulate the operative separation between the barbs and/or teeth 21 and 34.

Figure 2:
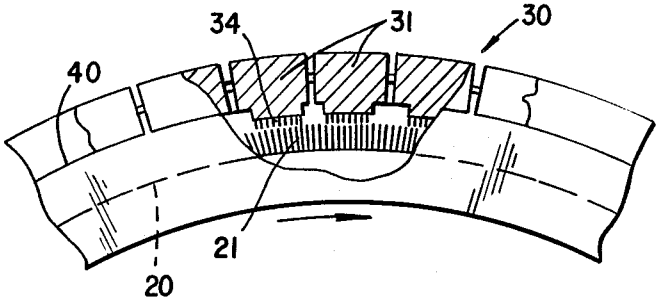
FIGS. 1 and 2 are schematic elevational side views, partially shown in section, of a card machine to which the present improvements have been incorporated.
Figure 3:
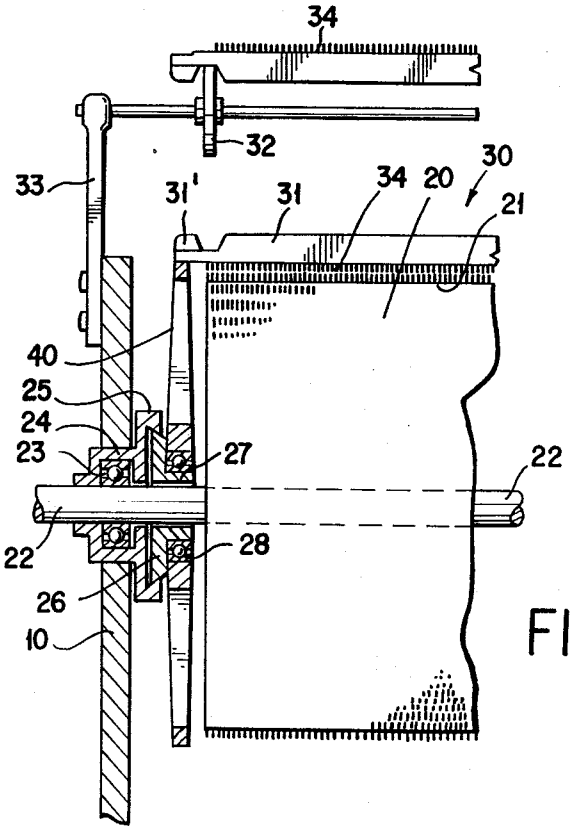
FIG. 3 shows a schematic view, in section, according to II—II in FIG. 1, where one of the conceived dynamic bearings is shown, the other one being symmetrically disposed in the machine.

A preferred embodiment of said tight-fitting means has been schematically represented in FIG. 3, in which the respective bearings 23 of the shaft ends 22 are located in two boxes 24 fixed to the corresponding sides of the structure or chassis 10.

Then, each box 24 presents conjointly a guide 25 of the type of dovetail or the like, and mounted on it, a sliding slider 26 of micrometric advance, referred to an adjustable scale (not shown) and related in an abutting relationship with lateral tight-fitting screws 29.

This slider presents conjointly a joint tubular projection 27 through which shaft 22 moves freely.

Corresponding wheel 40 is mounted on said projection 27 through the respective bearing 28.

Some modifications concerning certain details of present invention may be introduced when putting same into practice, without departing from its essential characteristics, the scope of the invention being clearly specified in following claims.

Having thus described and determined the nature of the present invention and the way to put same into practice, following is claimed as exclusive property and right:

1. In a textile raw material card machine comprising a structure whereupon a horizontal transversal carding cylinder is rotatively mounted on a shaft, its revolution surface being provided with barbs and operatively related with an upper carding surface that comprises an endless conveyor formed by a plurality of carding sheets transversely mounted in relation to the forward direction of said conveyor and articulated with respect to each other, said endless conveyor being disposed in such a way that its lower portion copies correspondingly the curvature of an upper circumferential sector of the carding cylinder, the improvement comprising a pair of coaxial idler wheels having approximately the same diameter as that of said cylinder, freely mounted relative to said shaft at a central portion thereof and having a periphery engaging said sheet ends for support thereof.

2. Improvements in a textile raw material card machine according to claim 1, wherein said coaxial idler wheels are mounted relative to bearings associated with said shaft by a dovetail guide and a slider.

* * * * *